United States Patent [19]

Ogawa

[11] 4,255,802

[45] Mar. 10, 1981

[54] ELECTRONIC TIMEPIECE

[75] Inventor: Hiroshi Ogawa, Tokorozawa, Japan

[73] Assignee: Citizen Watch Company Limited, Tokyo, Japan

[21] Appl. No.: 963,343

[22] Filed: Nov. 24, 1978

[30] Foreign Application Priority Data

Nov. 29, 1977 [JP] Japan ..... 52-142949
Dec. 7, 1977 [JP] Japan ..... 52-146865

[51] Int. Cl.[3] ..... G04C 17/00; G04B 23/02; G04C 9/00

[52] U.S. Cl. ..... 368/69; 368/73; 368/74; 368/187

[58] Field of Search ..... 58/23 R, 89.5, 58 R

[56] References Cited

U.S. PATENT DOCUMENTS

| | | | |
|---|---|---|---|
| 3,540,207 | 11/1970 | Keeler | 58/23 R |
| 3,852,951 | 12/1974 | Sauthier | 58/23 R |
| 4,030,283 | 6/1977 | Sauthier et al. | 58/23 R |
| 4,044,544 | 8/1977 | Yagi et al. | 58/23 R |
| 4,090,353 | 5/1978 | Maeda et al. | 58/89.5 |
| 4,094,135 | 6/1978 | Nomura et al. | 58/23 R |

*Primary Examiner*—Vit W. Miska
*Attorney, Agent, or Firm*—Holman & Stern

[57] ABSTRACT

An electronic timepiece having a pair of touch-sensitive electrostatic capacitance switches which must be actuated in a predetermined sequence to enable setting of time, etc. to be performed. Setting and selection of quantity to be set are thereafter conducted by actuating said switches.

4 Claims, 8 Drawing Figures

| Fig.3A | Fig.3B |
|---|---|

ELECTRONIC TIMEPIECE

This invention relates to a method of setting a desired value of a quantity such as time into an electronic timepiece by actuation of switches, and in particular to a method of conducting such setting by utilizing at least two completely sealed switches such as touch-sensitive electrostatic capacitance type switches.

In present designs of electronic wristwatches, almost operations are performed internally, in an automatic fashion. However it is necessary to provide some means of setting such quantities as the current time, an alarm time, date, etc., to a desired value, by the timepiece user. Such setting means normally includes an external actuating member which is mechanically coupled to a switch within the timepiece. Such an arrangement presents various problems with respect to sealing against the entry of dust and water, which are difficult to solve in an simple and economic way. It is possible to use various types of switching devices which provide complete isolation between the timepiece interior and the external environment.. Such switching devices include touch-sensitive electrostatic capacitance type switches, opto-electronic type switches, etc. However a problem which arises with such switches is that of accidental actuation, due for example to the switch being accidentally touched by the user. It is possible to employ an additional, mechanically coupled, switch as a safety switch, so that the touch-sensitive switches can only be actuated after the safety switch has been actuated. However this results in the previously mentioned problem of sealing against the external environment again arising, with the safety switch.

With an electronic timepiece in accordance with the present invention, the above problems are overcome by utilizing at least two touch-sensitive switches, and making it necessary for the switches to be actuated in a certain predetermined sequence in order to enable setting of the desired quantity to be performed. This enables the probability of accidental actuation of the switches to be reduced to a very low degree. With an electronic timepiece in accordance with the present invention, it is also possible to generate an audible alarm warning when the switches are set into the actuation-enabled state, thereby notifying the timepiece user in the event of accidental actuation.

It is therefore an object of the present invention to provide an electronic timepiece having improved means for setting quantities such as current time, alarm time, etc.

More particularly, it is an object of the present invention to provide an electronic timepiece having improved means for setting quantities such as current time, etc., in which at least two touch sensitive switches must be actuated in a predetermined sequence before such setting can be conducted.

Other objects, features and advantages of the present invention will be made more apparent from the accompanying description, when taken in conjunction with the attached drawings, whose scope is given by the appended claims.

Figure 1:
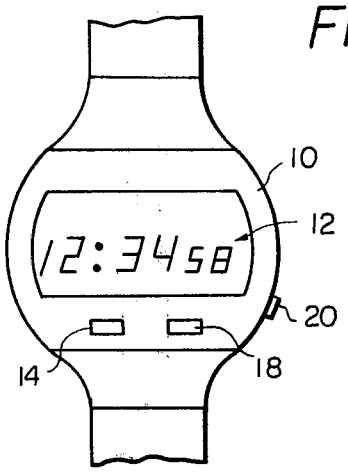
FIG. 1 is a view of the external appearance of an electronic timepiece of conventional type having an electro-optical display.

Referring now to the drawings, FIG. 1 shows, in plan view, the appearance of a conventional type of electronic wristwatch having an electro-optical display 12 to display time information. Numeral 10 indicates the casing of the timepiece, while numeral 14 indicates a first pushbutton switch used for selection of a digit of the time display 12 to be corrected. Correction is performed by actuating a second pushbutton switch 18, to set in a new value for the digit which has been selected. In order to prevent accidental unwanted actuation of switches 14 and 18, a safety switch 20 is provided, which must be pushed or turned to lock into a certain position before pushbutton switches 14 and 18 can be effectively actuated. It will be apparent that, even if switches 14 and 18 are of a type which is completely sealed against the external environment, this is extremely difficult to accomplish for safety switch 20. This is due to the fact that switch 20 must be moved physically in a manner which is unlikely to occur accidentally.

Figure 2:
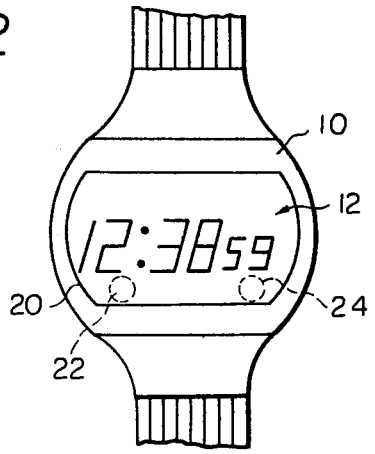
FIG. 2 is a view of the external appearance of an electronic timepiece in accordance with the present invention, having an electro-optical display.

FIG. 2 shows the external appearance, in plan view, of an embodiment of an electronic timepiece in accordance with the present invention, having an electro-optical display of time information. Numeral 20 indicates a glass face plate, on which are located first and second electrostatic capacity type touch switches 22 and 24. It will be apparent that a larger usable display area 12 is available in the embodiment in accordance with the present invention than with the conventional type of timepiece shown in FIG. 1, since touch switches 22 and 24 are in the form of layers of a transparent conductive film on a surface of face plate 20. To perform time setting with the embodiment shown in FIG. 2, it is first necessary to actuate touch-sensitive switches 22 and 24 in a certain predetermined sequence, to put the timepiece into a setting enabled status. Thereafter, switch 22 can be actuated to select the digits appearing in display area 12 which are to be set. Switch 24 is then actuated to set the selected digit to a desired value. When the timepiece has been put into the setting enabled status, then the entire time display begins to flash on and off. When switch 22 is actuated to select a digit for setting, then the selected digit (or digits) begins to flash on and off. When switch 22 is again actuated, after setting has been performed by actuating switch 24, then the adjacent digit is selected and begins to flash. Thus, after the hours digits have been corrected, the minutes digits can be selected by actuating switch 22. In each case, actuation of a switch is performed by touching the timepiece face plate at the switch position.

When time setting has been completed, no further operations by the user are necessary. When the timepiece circuit detects that a period of ten seconds have elapsed without either of switches 22 and 24 being touched, then the setting enabled status is automatically cancelled. Thereafter, it is necessary to again actuate switches 22 and 24 in the predetermined sequence in order to again place the timepiece in the setting enabled status.

It will thus be apparent that with an electronic timepiece in accordance with the present invention, it is not necessary to employ a safety switch such as that shown in FIG. 1, in order to prevent accidental actuation of completely sealed switches such as touch-sensitive switches, used for time setting purposes. The timepiece can thus be completely and effectively sealed, and thereby made completely waterproof and dustproof.

Figures 3, 3A:
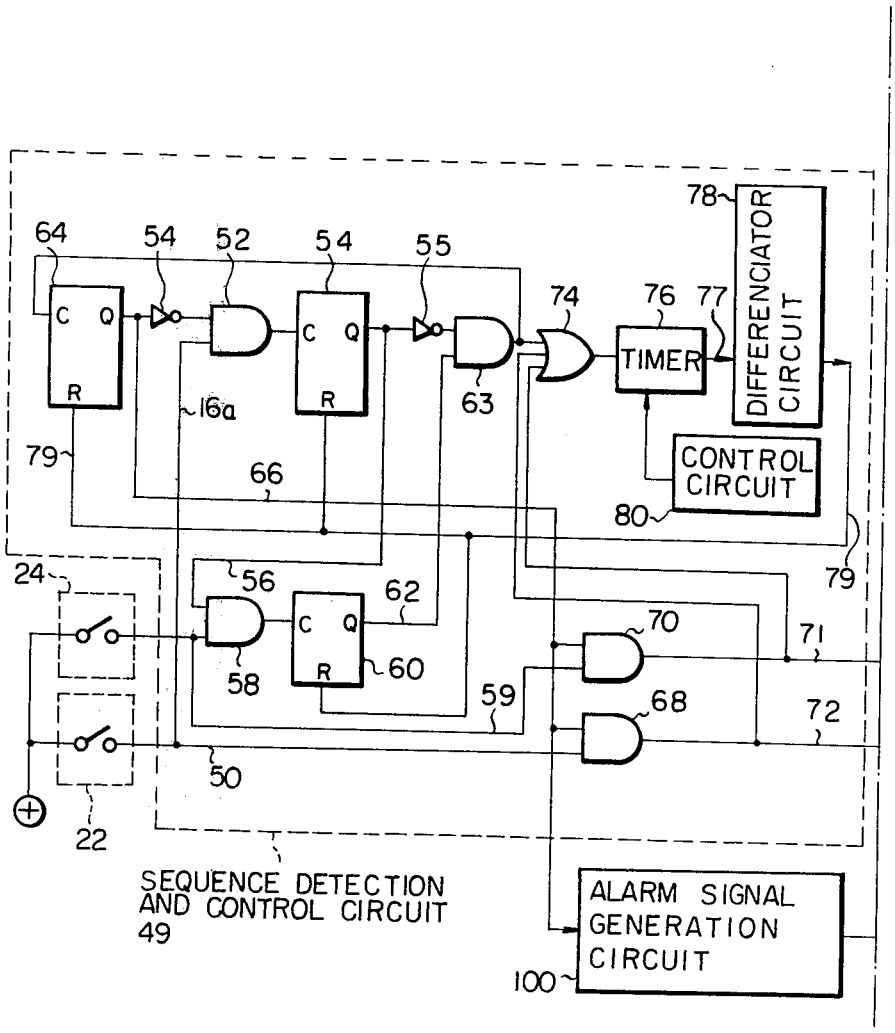
FIG. 3 is block diagram of the electronic timepiece shown in FIG. 2.
Figure 3B:
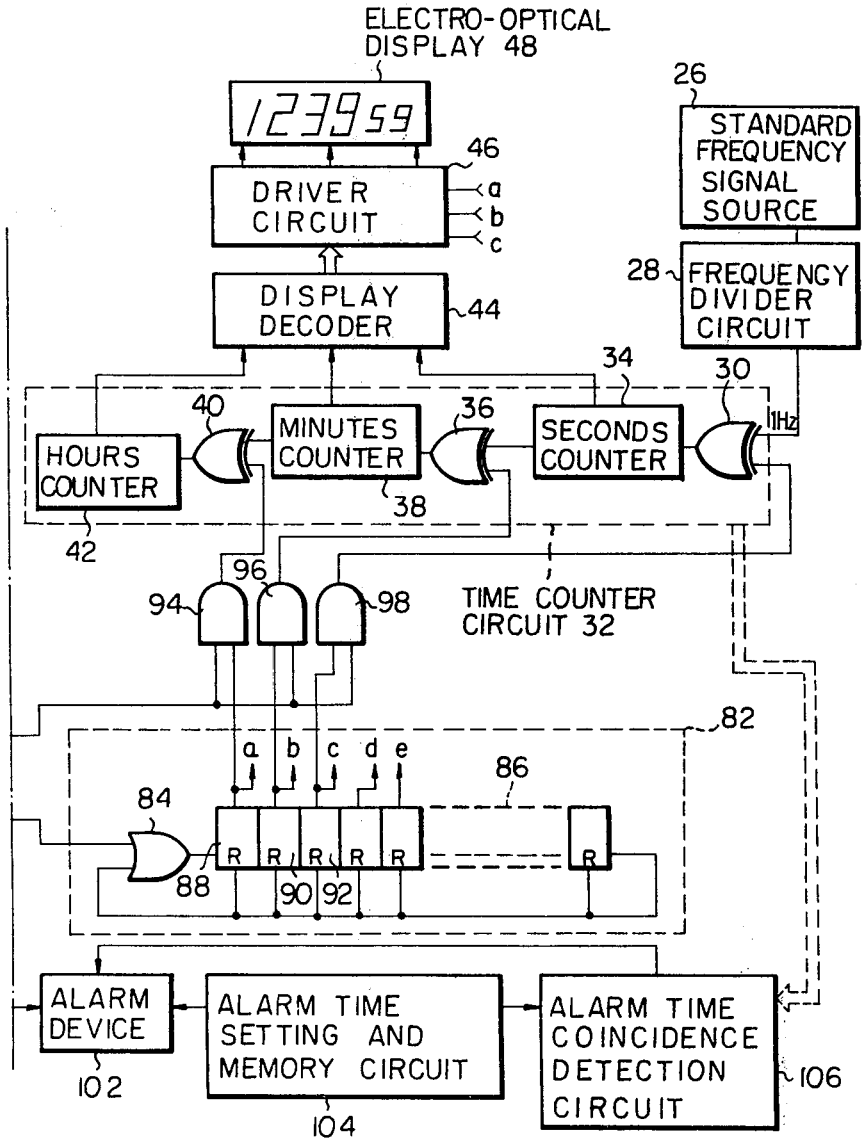

Referring now to FIG. 3, a simplified block diagram of the embodiment shown in FIG. 2 is given therein. A standard frequency signal is produced by a signal source such as a quartz crystal socillator circuit 26, and is supplied to a frequency divider circuit 28, which produces an output signal having a frequency of 1 Hz. This signal is applied through an exclusive OR gate 30 in a time counter circuit 32 to a seconds counter 34. A signal having a period of one minute is output by seconds counter 34 and is applied through exclusive OR gate 36 to a minutes counter 38. The output of minutes counter 38, with a period of one hour, is applied through exclusive OR gate 40 to an hours counter 42. The contents of the seconds counter 34, minutes counter 38 and hours counter 40 are applied through a display decoder circuit 44 to a display driver circuit 46, the output of which drives an electro-optical display 48.

Numeral 49 indicates a sequence detection and control circuit, which detects whether switches 22 and 24 are touch-actuated in a predetermined sequence, and produces a correction enable signal when actuation in said sequence is detected, enabling the contents of seconds counter 34, minutes counter 38 and hours counter 42 to be corrected. In sequence detection and control circuit 49, an electrode of touch-sensitive switch 22 is connected to one input of a first AND gate 52. The output of AND gate 52 is connected to the clock input terminal of a first flip-flop 54. Touch-sensitive switch 24 has one electrode connected to an input of a second AND gate 58, while the output of AND gate 58 is connected to the clock input terminal of a second flip-flop 60. The other input terminal of AND gate 58 is connected to the output from the Q terminal of flip-flop 54. The output of flip-flop 54 is also applied through an inverter 55 to one input of a third AND gate 63, while the other input of AND gate 63 is connected to the Q output terminal of flip-flop 60. The output of AND gate 63 is coupled to the clock input terminal of a third flip-flop 64, while the output from the Q terminal of flip-flop 64 is applied through an inverter 54 to AND gate 52. Switch 22 is also connected to one input terminal of a fourth AND gate 68, while switch 24 is also connected to one input of a fifth AND gate 70. The output of flip-flop 64 is connected to other input terminals of AND gates 68 and 70.

The outputs of AND gates 63, 68 and 70 are applied to the inputs of OR gate 74, the output of which is connected to a trigger input terminal of a timer circuit 76. The output of timer circuit 76 is applied to a differentiator circuit 78, the output of which is connected to the reset terminals of flip-flops 54, 60 and 64. These flip-flops function such that, when a transition from the low logic level voltage of the circuit (referred to hereinafter as the L level) to the high logic level voltage (referred to hereinafter as the H level) occurs at the clock input terminal of a flip-flop, the corresponding Q output changes from one logic level to the other.

The operation of sequence detection and control circuit 49 will now be described. To set the circuit into the correctable state, in which the output of flip-flop 64 goes to the H level, thereby enabling AND gates 68 and 70 to respond to actuation of switches 22 and 24, switch 22 must first be touched, then switch 24, then switch 22 once more. Time setting can then be initiated. When switch 22 is first actuated, this causes an H level input to be applied to the corresponding input terminal of AND gate 52. At this time, the output of flip-flop 64 is at the L level, so that the output of inverter 54 is at the H level. Thus, the output of AND gate 52 goes to the H level. The output of flip-flop 54 therefore goes to the H level, and remains at that level, thereby applying an H level input to the corresponding terminal of AND gate 58. If now switch 24 is actuated, then an H level output is produced by AND gate 58, causing the output of flip-flop 60 to go to the H level.

In this condition, if switch 22 is actuated once more, then the output of AND gate 52 again goes from the L level to the H level, causing the output of flip-flop 54 to go from the H level to the L level. As a result, an L level output is produced by inverter 55. Since the output of flip-flop 60 is still at the H level, an H level output is produced by AND gate 63, causing the output of flip-flop 64 to go from the L level to the H level. An H level input is therefore applied to inputs of AND gates 68 an 70 on line 66, serving as a setting enable signal, since AND gates 68 and 70 are now enabled to pass selection and setting signals from switches 22 and 24.

When the setting enabled state is entered, then the output of AND gate 63 goes to the H level, causing the output of OR gate 74 to go from the L to the H level. This transition from the L to H level causes timer circuit 76 to be triggered to produce an H level output. This is applied to differentiator circuit 78, which produces no output at that time. The on period of timer circuit 76 is set beforehand to ten seconds, by means of control circuit 80. Each time switch 24 or 22 is actuated, with the circuit in the setting enabled condition, then the output of OR gate 74 goes from the L level to the H level, thereby retriggering timer circuit 76. When ten seconds have elapsed without either switch 22 or switch 24 having been actuated, in the setting enabled condition, then the output of timer circuit 76 goes from the H level to the L level. This causes differentiator circuit 78 to generate an H level pulse of short duration, which is applied to the reset terminals of flip-flops 54, 60 and 64, thereby resetting the outputs of these flip-flops to the L level. AND gates 68 and 70 are thereby inhibited, so that setting by means of switches 22 and 24 can no longer be performed.

The output of AND gate 68, which consists of selection control signals produced in acordance with actuation of switch 22, is applied to an input of an OR gate 84 in a selection circuit 82, used to select the digits of the time information which are to be corrected. Selection circuit 82 contains a shift register 86, having an input shift clock terminal connected to receive the output of OR gate 84. Outputs of first stage 88, second stage 90 and third stage 92 of shift register 86 are connected to display driver circuit 46. These serve as control outputs for digit selection and are denoted by the letters a, b and c respectively in FIG. 3. When one of control outputs a, b or c goes to the H level, then the corresponding digits on display 48 flash on and off to indicate that they have been selected for correction. With the timepiece in the setting enabled state, as described in the previous paragraphs, then successive actuations of switch 22 cause outputs a, b, c, d, e, etc. of shift register 86 to successively go to the H level, as successive L level to H level transitions occur at the output of AND gate 68 and hence the output of OR gate 84. The control outputs a, b and c of shift register 86 are connected to inputs of AND gates 94, 96 and 98, respectively. The output of AND gate 70 of sequence detection and control circuit 49, which consists of setting signals produced in accordance with actuation of switch 24, is connected to the other inputs of AND gates 94, 96 and 98. Input terminals of exclusive OR gates 40, 36 and 30 are connected to receive the outputs of AND gates 94, 96 and 98 respectively.

Thus, for example, if output "a" of shift register 86 is at the H level, when the timepiece has been placed in the setting enabled status, then actuations of switch 24 will cause voltage transitions to occur at the output of AND gate 71, which are passed through AND gate 94 to the input of exclusive OR gate 40. In this case, each time switch 24 is actuated, an L to H level transition will occur at the output of exclusive OR gate 40, causing the hours display digits to be incremented by one unit. If switch 22 is not actuated, then output "a" of shift register 86 will go to the L level and output "b" will go to the H level. The setting signal produced from AND gate 70 by actuation of switch 24 will now be passed through AND gate 96 to the input of exclusive OR gate 36, so that each time switch 24 is actuated, minutes counter 38 will be incremented by one unit. Similarly, if switch 22 is again actuated, the contents of seconds counter 34 can be incremented by actuating switch 24. Further outputs may be provided from shift register 86 by succeeding stages, as indicated by the letters "d" and "e". Such outputs may be utilized to allow setting of an alarm time, date, etc. It is also possible to connect the final stage output of shift register 86 to differentiator circuit 78, so that when all desired quantities have been set or corrected, a final actuation of switch 22 causes differentiator circuit 78 to produce a pulse which resets the flip-flops of sequence detection and control circuit 49, thereby cancelling the setting enabled condition of the timepiece.

By providing additional gates and additional stages in shift register 86, the above embodiment can easily be modified to permit the units and tens digits of the hours, minutes and seconds to be individually selected and corrected.

The embodiment of the present invention shown in FIG. 3 also includes an alarm function. This is provided by an alarm coincidence detection circuit 106, which compares the current time information in time counter circuit 32 with the contents memorized in an alarm time setting and memory circuit 104. When coincidence between the alarm time and the current time is detected, then alarm device 102 is actuated to generate an audible alarm signal. A control input terminal of an alarm signal generation circuit 100 is connected to receive the setting enable signal produced by flip-flop 64 of sequence detection and control circuit 49, and produces an output signal when the output of flip-flop 64 goes to the H level which causes an audible alarm signal to be generated by alarm device 102. Thus, each time the timepiece is put into the setting enabled status, an audible alarm signal is generated. If the setting enabled status should be entered accidentally, therefore, the timepiece user will be immediately notified, and can then cancel the status. Such an arrangement is also convenient for setting the time, date, etc., since the user is made aware of whether or not the timepiece is in the setting enabled status.

Figure 4:
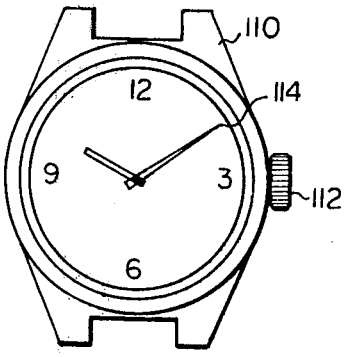
FIG. 4 shows the external appearance of an electronic timepiece of conventional type having a crown used for time setting purposes.

The present invention is also applicable to electronic timepieces which utilize time indicating hands driven through a gear train by a stepping motor for time display. A conventional form of such a timepiece is shown in FIG. 4, in which numeral 112 indicates a crown, which is used for setting the time indicated by hands 114. The use of such a crown for time setting, which may for example be rotated in order to successively actuate an internal switch, results in various problems with respect to sealing against moisture and dust, since the crown must be physically moved and is coupled to internal elements of the timepiece.

Figure 5:
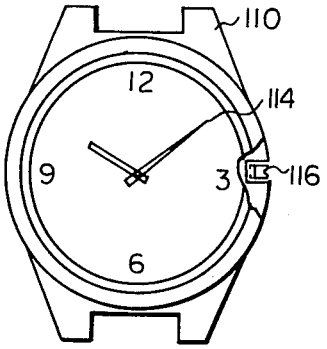
FIG. 5 shows another electronic timepiece of conventional type having time indicating hands and a recessed actuation member for time setting purposes.

Another form of conventional electronic timepiece employing time indicating hands is shown in FIG. 5. In this case, a recessed type of push switch is employed for time setting. This switch must be depressed by means of a small object such as a toothpick in order to perform time setting. Although the use of such a switch enables a timepiece having a smoother and more elegant external shape to be produced, as compared with a timepiece using a crown, the problems of sealing against moisture and dust still occur, while the mechanical design may be complex.

Figure 6:
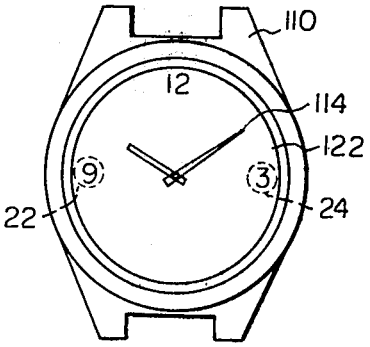
FIG. 6 shows an embodiment of an electronic timepiece in accordance with the present invention having time indicating hands.
Figure 7:
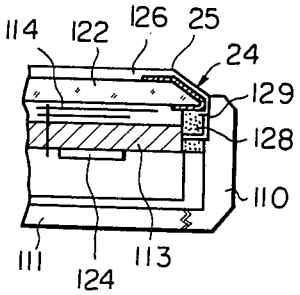
FIG. 7 is a partial cross-sectional view of the electronic timepiece shown in FIG. 6 showing a touch-sensitive electrostatic capacity type switch.
Figure 8A:
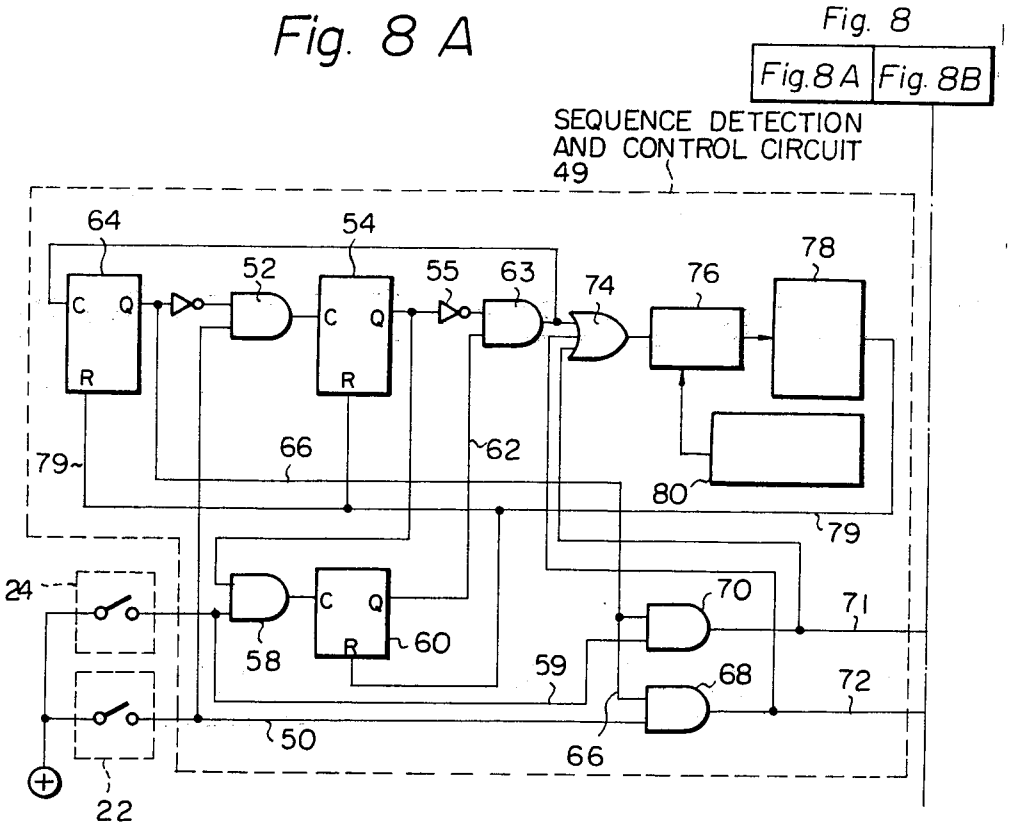
FIG. 8 is a block diagram of the electronic timepiece shown in FIGS. 6 and 7.
Figure 8B:
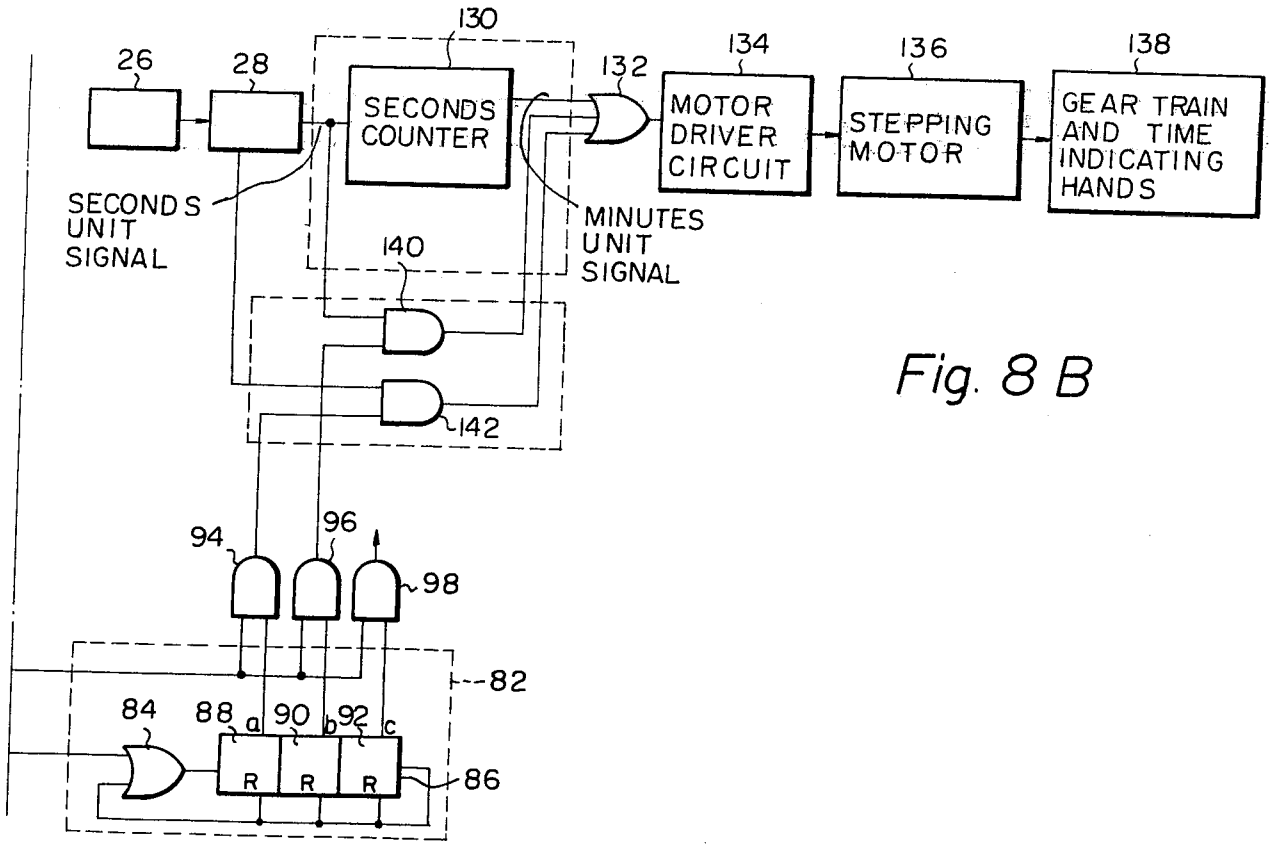

An embodiment of an electronic timepiece in accordance with the present invention having time indicating hands is shown in FIG. 6, in plan view. As in the case of the first embodiment described above, time setting is performed by utilizing two touch-sensitive electrostatic capacity type switches 22 and 24, arranged, as shown, near the periphery of the timepiece dial. FIG. 7 is a partial cross-sectional view of the timepiece of FIG. 6 showing the construction of switch 24. This consists of a transparent film of a conductive material 25 formed on part of the front surface of transparent face plate 122, and extending over the side of face plate 122 to its rear surface. Transparent conductive film 25 functions as an electrode of touch switch 24, and is partially covered with a layer of insulating transparent plastic material 126. Numeral 129 indicates a layer of conductive rubber which serves both to establish electrical contact with conductive film 25 and to provide a waterproof seal for face plate 122. The surface of conductive rubber layer 129 is covered with a thin layer of insulating rubber between layer 129 and the timepiece case 110. The timepiece dial plate 113 also serves as a circuit board to carry an integrated electronic circuit 124, which has a printed circuit pattern (not shown) electrically connected to conductive film 25 by means of conductive rubber layer 129. Referring now to FIG. 8, a block diagram of the embodiment of the present invention shown in FIG. 7 is given therein. Numeral 49 indicates a sequence detection and control circuit, whose functions and components are similar to those of the corresponding circuit described for the first embodiment of the present invention. Numeral 82 indicates a selection circuit, whose components and functions are similar to those of the corresponding circuit described fo the first embodiment of the present invention. A standard frequency signal from frequency source 26 is applied to frequency divider circuit 28, which produces an output signal having a frequency of one Hz, designated in the diagram as the seconds unit signal. This signal is applied to a seconds counter circuit 130, which produces an output signal having a period of one minute. This minutes unit signal is applied through an OR gate 132 to a motor driver circuit 134, the output of which drives a stepping motor 136. Stepping motor 136 drives time indication means 138 comprising time indicating hands 114 and a gear train.

The seconds unit signal from frequency divider 28 is applied to one input of an AND gate 140, the other input of which is connected to the output of AND gate 96. An intermediate frequency output of frequency divider 28 is applied to one input of an AND gate 142, the other input of which is connected to the output of AND gate 94.

The operation of this circuit will now be described. First, with the timepiece operating in the normal status, i.e. not in the setting enabled status, a signal having a period of one minute is applied to motor drive circuit 134 from the output of OR gate 132. The minutes hand of the timepiece is thereby advanced at a rate of one step per minute. If now switches 22 and 24 are actuated in the same perdetermined sequence as described for the first embodiment of the present invention, i.e. first switch 22, then switch 24, then switch 22 once more, the timepiece is put into the setting enabled status. An H level output is produced by flip-flop 64 and applied on line 66 to inputs of AND gates 68 and 70. If control outupt a of shift register 86 is now at the H level, then when switch 24 is actuated, thereby generating an H level setting signal from AND gate 70, the output of AND gate 94 will go to the H level. This enables the intermediate frequency output of frequency divider 28 to be passed through AND gate 140, and applied through OR gate 132 to motor driver circuit 134, together with the minutes unit signal from seconds counter 130. As a result, stepping motor 136 is rotated at a much higher speed than normal, so long as switch 24 is kept actuated. The hours hand of the timepiece can therefore be easily set to a desired time value within a short period of time. If, when setting of the hours hand has been completed, switch 22 is again actuated, then a selection control signal will be produced from the output of AND gate 68, causing output a of shift register 86 to go to the L level and output b to go to the H level. If now switch 24 is actuated, then an H level setting signal will be produced from AND gate 70, so that the output of AND gate 96 will go to the H level. As a result, AND gate 140 is enabled to pass the seconds unit signal from the output of frequency divider 28 to the input of OR gate 132. The seconds unit signal is therefore applied from OR gate 132, together with the minutes unit signal, to motor driver circuit 134. As a result, the time indicating hands 114 will be rotated by stepping motor 136 at a convenient rate for setting the minutes hand to a desired value. This rate of rotation will be continued so long as switch 24 is kept actuated. If switch 22 is again actuated, then output c of shift register 86 goes to the H level, while output b goes to theL level. When switch 24 is now actuated, the output of AND gate 98 will go to the H level. The output of AND gate 98 may be utilized for various purposes. If stepping motor 136 is of reversible type, then the output of AND gate 98 can be used to cause reverse rotation of the motor. Alternatively, this output can be connected to some means for setting the seconds hand of the timepiece to zero, so that the seconds of time can be set precisely to zero in accordance with a standard time signal, by the timepiece user.

In this embodiment, shift register 86 is shown as having three stages. However, as in the case of the first embodiment described above, a greater number of stages may be provided, so that control outputs to perform various other functions can be selected.

As in the case of the first embodiment of the present invention, timer circuit 76 causes the setting enable state to be cancelled after a period of ten seconds has elapsed without switches 22 or 24 being actuated.

Although the above descriptions of the present invention have been of embodiments in which electrostatic capacity type touch-sensitive switches are used for time setting and selection, it should be noted that various other types of switch may be utilized. These include opto-electric type switches, pushbutton type switches, etc. It should also be noted that although the described embodiments employ only two switches for time setting and selection, it is equally possible to utilize a greater number of switches. In this case, it is possible to arrange that all of such switches must be actuated in a predetermined sequence in order to place the timepiece in a setting enabled status, or to arrange that only a part of said switches must be actuated in a predetermined sequence to attain the setting enabled status.

Also, although the embodiments of the present invention described above provide a display of hours, minutes and seconds, it is also possible to utilize the present invention to provide an electronic timepiece having a display of the date, weekday, etc.

Thus, although the present invention has been shown and described with respect to particular embodiments, it should be noted that various changes and modifications to these embodiments are possible, which fall within the scope claimed for the present invention.

What is claimed is:

1. An electronic timepiece having timekeeping means for producing time information, time display means for displaying said time information, a casing including a transparent face plate disposed to cover said time display means, and setting means comprising:

- a plurality of externally actuated touch-sensitive switches;
- a first AND gate having a first input terminal coupled to a first one of said externally actuated switches;
- a first flip-flop having a clock input terminal coupled to an output of said first AND gate;
- a second AND gate having a first input terminal coupled to a second one of said externally actuated switches and a second input terminal coupled to an output of said first flip-flop;
- a second flip-flop having a clock input terminal coupled to an output of said second AND gate;
- a third AND gate having a first input terminal coupled to the inverse of said output of the first flip-flop and having a second input terminal coupled to an output of said second flip-flop;
- a third flip-flop to produce a detection signal, having a clock terminal coupled to an output of said third AND gate and having an inverted output coupled to a second input terminal of said first AND gate;
- a fourth AND gate, for producing said selection control signal, having a first input terminal coupled to said first one of said externally actuated switches and a second input terminal coupled to receive said detection signal;

a fifth AND gate, for producing said setting signal, having a first input terminal coupled to said second one of said externally actuated switches and having a second input terminal coupled to receive said detection signal;

an OR gate having first, second and third input terminals coupled to output of said third, fourth and fifth AND gates, respectively;

a timer circuit having a control terminal coupled to receive an output of said OR gate; and a differentiator circuit coupled to an output of said timer circuit and having an output connected to reset terminals of said first, second and third flip-flops.

2. An electronic timepiece according to claim 1, in which each of said touch-sensitive switches includes an electrode formed upon a surface of said transparent face plate.

3. An electronic timepiece according to claim 1, in which said time display means comprises an electro-optical display.

4. An electronic timepiece according to claim 1, in which said time display means comprises a dial and time indicating hands driven by a stepping motor.

* * * * *